US005819977A

United States Patent [19]

Sannes

[11] Patent Number: 5,819,977

[45] Date of Patent: Oct. 13, 1998

[54] TOWER DEVICE IN SPERICAL TANKS FOR THE TRANSPORT OF LIQUID GAS

[75] Inventor: Lars Sannes, Moss, Norway

[73] Assignee: Kvaerner Moss Technology a.s., Lysaker, Norway

[21] Appl. No.: 596,344

[22] PCT Filed: Aug. 18, 1994

[86] PCT No.: PCT/NO94/00134

§ 371 Date: Mar. 6, 1996

§ 102(e) Date: Mar. 6, 1996

[87] PCT Pub. No.: WO95/05557

PCT Pub. Date: Feb. 23, 1995

[30] Foreign Application Priority Data

Aug. 19, 1993 [NO] Norway ..... 932956

[51] Int. Cl.[6] ..... B65D 90/02

[52] U.S. Cl. ..... 220/567; 220/584; 220/4.12

[58] Field of Search ..... 220/581, 584, 220/4.12, 567

[56] References Cited

U.S. PATENT DOCUMENTS 3,707,078 12/1972 Cramer .

FOREIGN PATENT DOCUMENTS 0039101 11/1981 European Pat. Off. .
2324680 12/1973 Germany .
6-324500 2/1988 Japan .
140944 9/1979 Norway .
433257 5/1984 Sweden .

*Primary Examiner*—Joseph M. Moy
*Attorney, Agent, or Firm*—Birch, Stewart, Kolasch & Birch, LLP

[57] ABSTRACT

The tower or tower foot for a spherical tank for use in the transport of cold products is designed in order to be able to absorb stresses from the tower on the tank shell with a desired degree of flexibility, preferably in the tower foot, e.g. in a zone (A-A') thereof, and/or as a flexible element.

17 Claims, 3 Drawing Sheets

TOWER DEVICE IN SPERICAL TANKS FOR THE TRANSPORT OF LIQUID GAS

FIELD OF THE INVENTION

The invention concerns a tower device in spherical tanks for the transport of liquid gas, wherein the tower extends between the bottom and the top of the tank, comprising a device which permits mutual movement of sections of the tower and the tank in the tower's longitudinal direction.

DESCRIPTION OF THE BACKGROUND ART

From the prior art it is known that a tower can be permanently secured in a spherical tank which is used for the transport by ship of cold products, e.g. liquid natural gas (LNG). Even though problems were thereby eliminated with which the previous devices were encumbered, a new problem was created. In certain situations, for example, when the tower has a different temperature to the tank shell, when the tank is completely or partially filled, or when the tower is subjected to forces from splashing of liquid in the tank, the tower sets up extra stresses in the tank shell. These can be reduced, e.g. by increasing the thickness of sections of the tank shell. Since this is impractical, it has been suggested that a section of the tank near the top of the tower should be flattened out somewhat, thus making the tank shell more elastic at this point. However, for reasons connected with production, it is not desirable for the shape of the tank to deviate from the spherical shape, and no such flattening out has been performed in practice.

Alternatively an elastic or flexible element can be installed or a transition in the tower at an optimum level, depending on design and operational factors.

The design of flexible transitions of this kind will vary since different requirements can be placed on the design on the basis of the tank's size, the location for the tank's installation (on board ship or ashore) and thereby the desired stresses in the tank shell, various requirements for equipment (e.g. pumps) and thereby the requirements for space in the tower foot, various properties of the loads which have to be carried (e.g. LPG, ethylene, LNG or liquid nitrogen, oxygen or hydrogen) which thus will give different combinations of static and dynamic loads, and different materials in the tank. The solution which is best for one combination of these requirements is not necessarily best for another combination. The known transitions create relatively few variable parameters, a fact which limits the choice of optimum solutions for the elastic connection or transition.

SUMMARY OF THE INVENTION

The object of the invention is to provide a device of the above-mentioned type which is encumbered in a less degree with these disadvantages while retaining the main principle that the tower should be fixedly secured.

The characteristics of the invention are indicated by the features in the claims presented.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described in more detail with reference to the drawing which schematically illustrates embodiments of the device according to the drawings which are given by way of illustration only, and thus are not limitative of the present invention, and wherein.

DETAILED DESCRIPTION OF THE PREFERRED EMBODIMENTS

Figure 1:
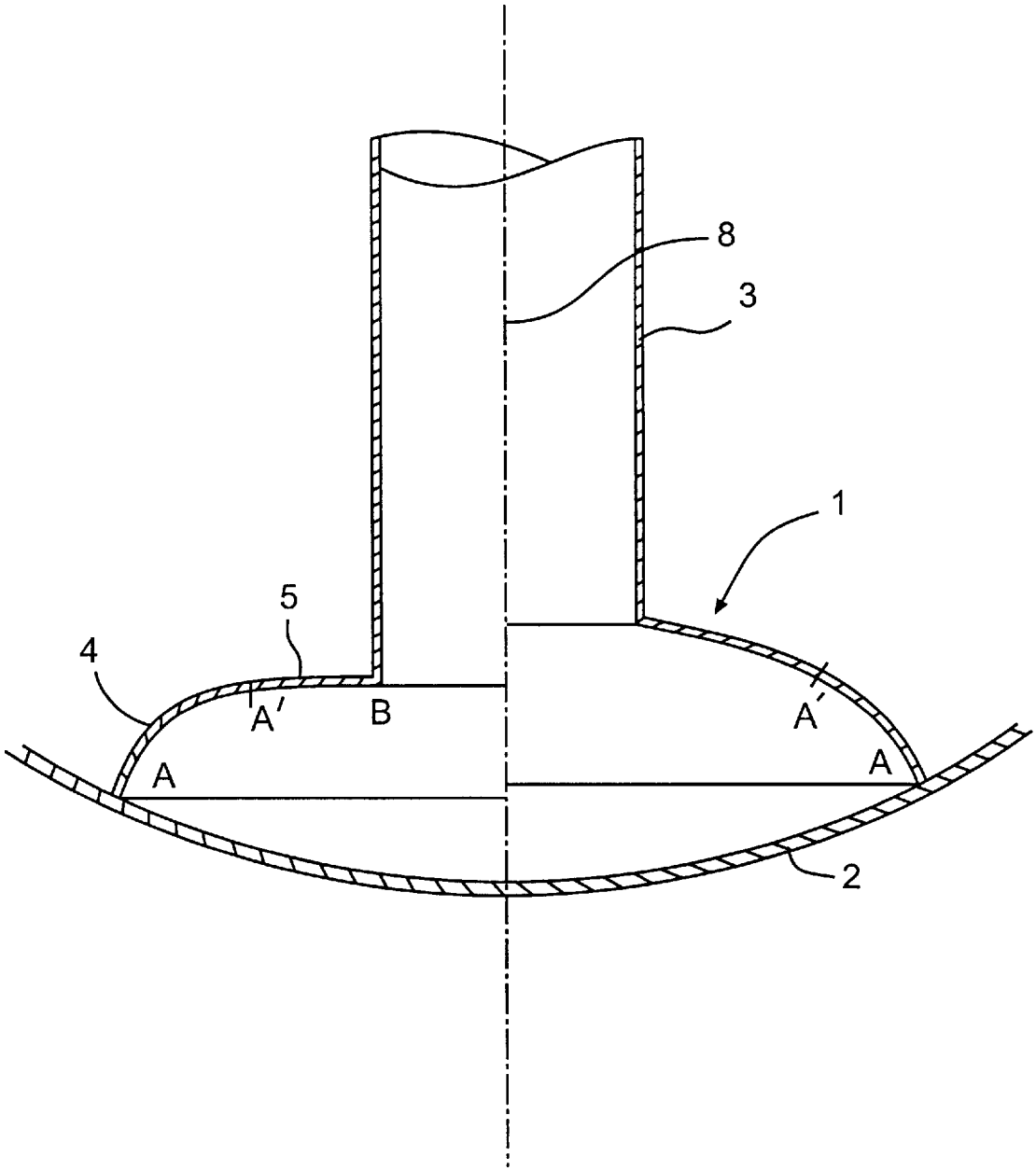
FIG. 1 illustrates a longitudinal section through a first and a second embodiment of a device according to the invention, where the embodiments are shown on respective sides of the tower's longitudinal axis.

As illustrated in FIG. 1, between a tank 2 and a vertically extending tower 3, a flexible transition section 1 is provided. The flexibility is principally provided by a double-curved, annular or continuous peripheral element 4 (shown by quarter-circles A-A'). This peripheral element 4 is connected to the tower 3 via a connecting element 5 (illustrated by line A'-B) which can, however, be omitted if this is considered expedient. Alternatively the peripheral element 4 can be designed as a number of single-curved plates which are welded to the connecting element 5 at point A' and the tank wall at point A. Thus in this case, the peripheral element 4 will be discontinuous.

In the first embodiment of the device according to the invention which is illustrated on the left side of the tower's longitudinal axis 8, the connecting element 5 is composed of a flat plate, but it can be conical instead.

In the second embodiment of the device according to the invention which is illustrated on the right side of the tower's longitudinal axis 8, the connecting element 5 is composed of a part of a spherical surface, and in this case the entire construction is in the form of a korbogen structure (A-B), the peripheral element 4 being composed of a section of a torus. Korbogen structures are well known in the field of tank structures and thus form torus-spherical structures.

The connecting element 5 can be used to support pipes. For this or for other reasons, it may be desirable to have the connecting element 5 reinforced, e.g. by means of radially extending struts. In order to save materials, the connecting element 5 can be provided with cut-outs or possibly consist of only radial struts.

Figure 2:
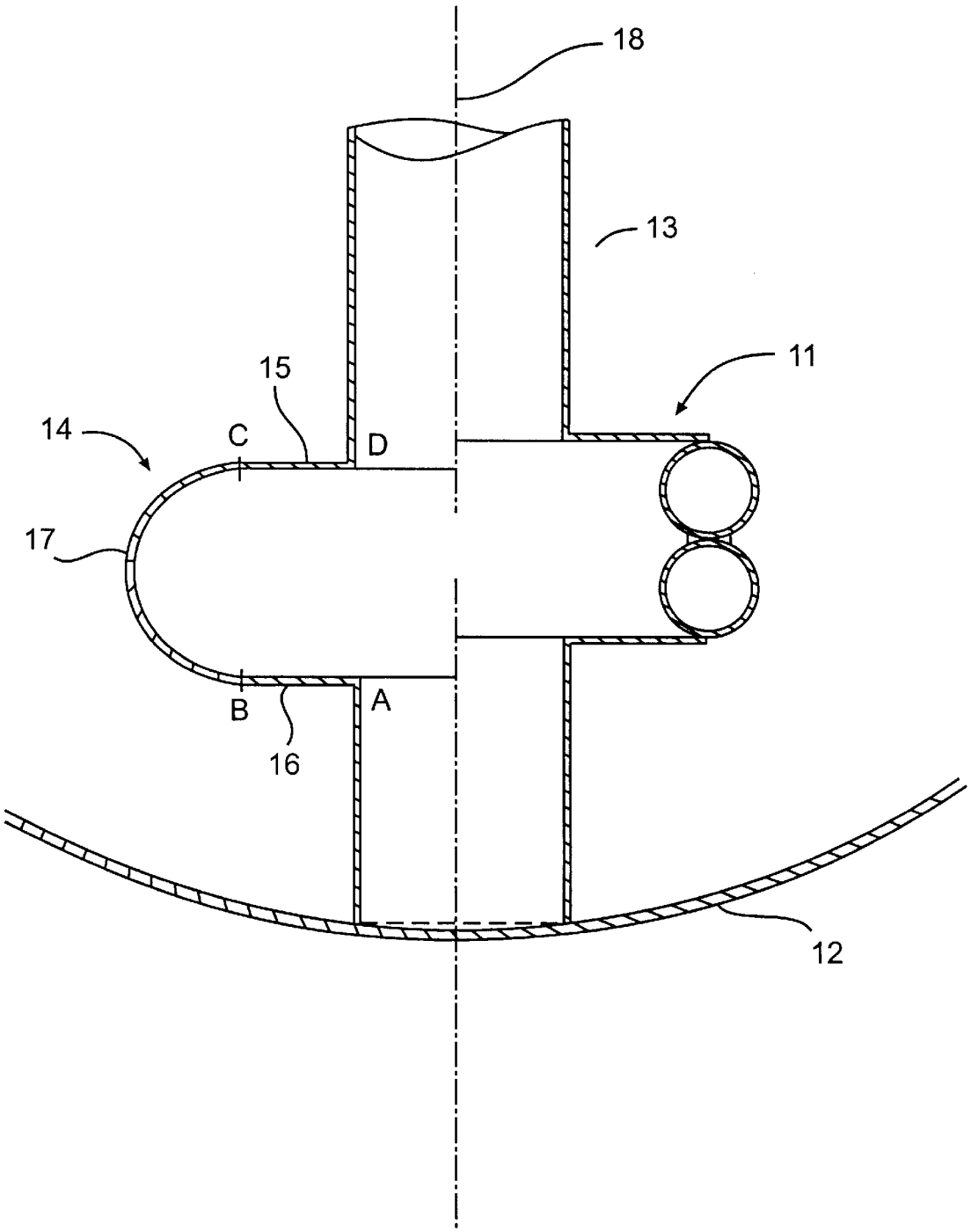
FIG. 2 illustrates a longitudinal section similar to that which is illustrated in FIG. 1, through a third and a fourth embodiment of the device according to the invention.

In FIG. 2, a longitudinal section through a third and a fourth embodiment of a device according to the invention are illustrated. A transition section 11 between a tank 12 and a tower 13 is in the form of an annular, bellows-shaped, elastic peripheral element 14.

The diameter and rigidity of two horizontal connecting elements, 15, 16 (illustrated by lines A-B and C-D) which connect the peripheral element 14 with the tower, can be selected according to what is considered most appropriate. In this connection those sections of the tower which are located above and below the peripheral element 14 can have different diameters, for example with regard to requirements for space inside the tower.

On the left half of FIG. 2, a half longitudinal section through the third embodiment of the device according to the invention is shown. The peripheral element 14 is composed of an element 17 which is semicircular in cross section (semicircle B-C).

At the section of the figure which is located on the right of the tower's longitudinal axis 18, and which shows a half longitudinal section through the fourth embodiment of the device according to the invention, the peripheral element 14 comprises a number of welded, annular elements which are in the form of pipes. They can, however, be in the form of half pipes.

The bellows section can be provided at the point on the tower which is considered the most suitable.

The details specified in connection with FIG. 1 regarding cut-outs and reinforcement also apply for this embodiment.

Figure 3:
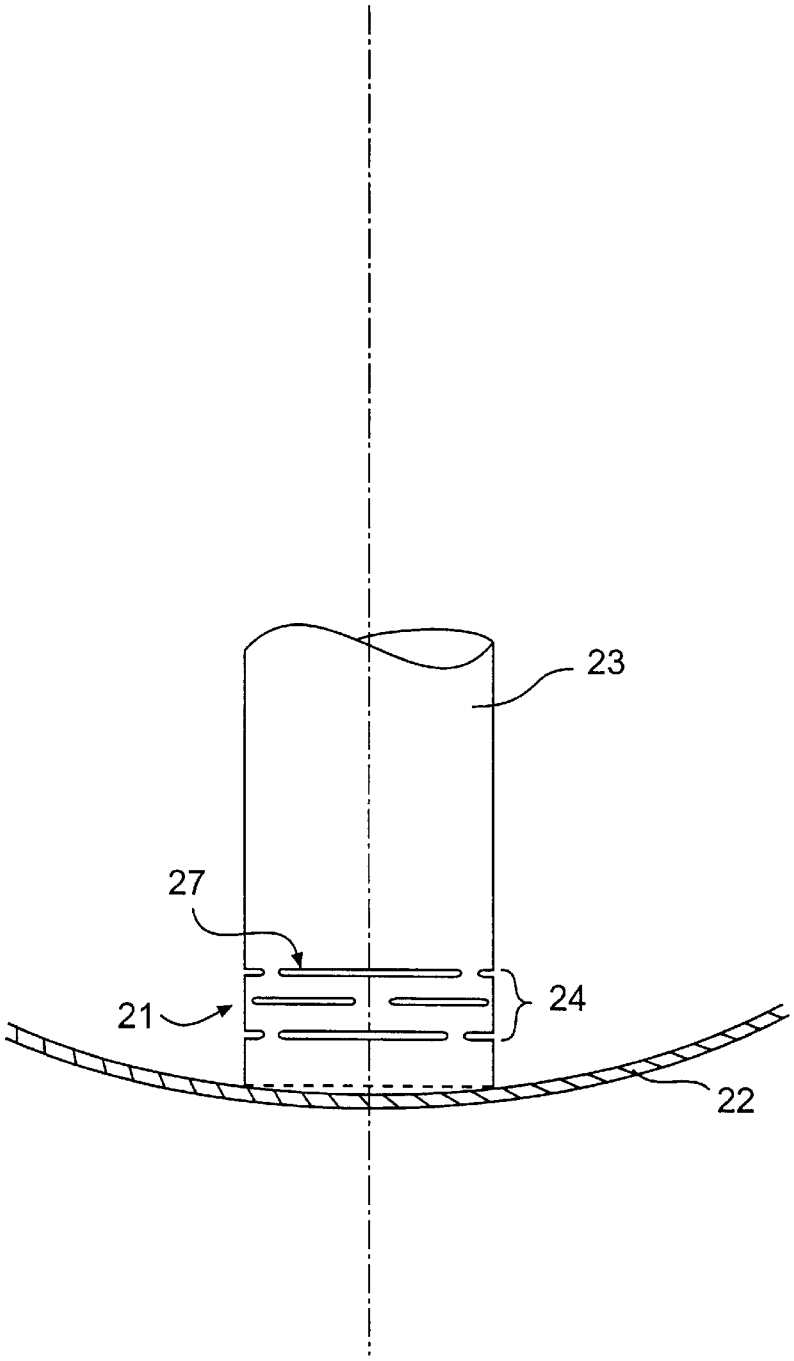
FIG. 3 illustrates a longitudinal section through a fifth embodiment of the device according to the invention.

In FIG. 3, a longitudinal section through a fifth embodiment of a device according to the invention is illustrated. A transition section 21 through a tower 23 and a tank 22 is composed of a section 24 of the tower structure, where this section 24 has been made elastic by the formation of horizontal slots 27 in the tower wall. The number and extent of the slots is adapted to the existing requirements for flexibility.

Even though a cylindrical tower 23 is shown, however, the elastic, slotted section 24 can be conical in shape or have a different diameter. This can be necessary in order to provide room for equipment inside the tower or in order to obtain acceptable stress levels in the slotted part of the tower.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A tower device in a spherical tank, the tower device comprising:

a tower extending between a bottom and top of the tank; and an elastic device for permitting reciprocal movement between the tower and the tank in a longitudinal direction of the tower and in directions non-parallel to the longitudinal direction of the tower, the elastic device having greater elasticity than the tower and being located on the tower and having a curved section.

2. The tower device according to claim 1, wherein the spherical tank is for transport of liquid gas and wherein the curved section of the elastic device has a toroidal shape.

3. The tower device according to claim 1, wherein the curved section of the elastic device comprises a single curved section with greater elasticity than the tower.

4. The tower device according to claim 1, wherein the elastic device is located a foot of the tower.

5. The tower device according to claim 1, wherein the elastic device comprises an annular peripheral element located between the tower and the tank.

6. The tower device according to claim 1, wherein the elastic device comprises a peripheral element located between the tower and the tank, the peripheral element having a section with a torus shape.

7. The tower device according to claim 1, wherein the elastic device comprises an annular, bellows-shaped elastic element located on the tower.

8. The tower device according to claim 1, wherein the elastic device comprises a peripheral element having a semicircular cross section, the peripheral element being located on the tower.

9. The tower device according to claim 1, wherein the elastic device comprises at least one pipe mounted on the tower, the at least one pipe divides the tower into two sections.

10. A tower device in a spherical tank, the tower device comprising:

a tower extending between a bottom and top of the tank; and means for enabling movement between the tower and the tank, the means enabling reciprocable movement in a longitudinal direction of the tower and reciprocable movement in directions non-parallel to the longitudinal direction of the tower, the means for enabling having greater elasticity than the tower and being located on the tower and having a curved section.

11. A The tower device according to claim 10, wherein the spherical tank is for transport of liquid gas and wherein the means for enabling movement comprises an elastic device having the curved section, the curved section having a toroidal shape.

12. The tower device according to claim 10, wherein the curved section of the means for enabling movement is on an elastic device with a single curved section having greater elasticity than the tower.

13. The tower device according to claim 10, wherein the means for enabling movement is located at a foot of the tower.

14. The tower device according to claim 10, wherein the means for enabling movement comprises an annular peripheral element located between the tower and the tank.

15. The tower device according to claim 10, wherein the means for enabling movement comprises a peripheral element located between the tower and the tank, the peripheral element having a section with a torus shape.

16. The tower device according to claim 10, wherein the curved section of the means for enabling movement is on a peripheral element having a semicircular cross section, the peripheral element being located on the tower.

17. The tower device according to claim 10, wherein the means for enabling movement comprises at least one pipe mounted on the tower, the at least one pipe divides the tower into two sections.

* * * * *